US012622471B2

(12) United States Patent
Weber et al.

(10) Patent No.: US 12,622,471 B2
(45) Date of Patent: May 12, 2026

(54) CLOSURE SYSTEM FOR GARMENTS

(71) Applicant: Even Adaptive Corporation, Baltimore, MD (US)

(72) Inventors: Marianne H. Weber, Baltimore, MD (US); Rebeccah Pailes-Friedman, Brooklyn, NY (US); Aybuke Sahin, Brooklyn, NY (US); Yukiko Naoi, New York, NY (US); Mallory Blackburn, Brooklyn, NY (US)

(73) Assignee: Even Adaptive Corporation, Baltimore, MD (US)

( * ) Notice: Subject to any disclaimer, the term of this patent is extended or adjusted under 35 U.S.C. 154(b) by 191 days.

(21) Appl. No.: 18/374,088

(22) Filed: Sep. 28, 2023

(65) Prior Publication Data

US 2024/0108083 A1 Apr. 4, 2024

Related U.S. Application Data

(60) Provisional application No. 63/411,397, filed on Sep. 29, 2022.

(51) Int. Cl.

| | |
|---|---|
| ***A41C 3/02*** | (2006.01) |
| ***A44B 17/00*** | (2006.01) |
| *A41F 1/00* | (2006.01) |

(52) U.S. Cl.

CPC ..... *A41C 3/02* (2013.01); *A44B 17/0041* (2013.01); *A41F 1/002* (2013.01); *A44D 2203/00* (2013.01)

(58) Field of Classification Search

None

See application file for complete search history.

(56) References Cited

U.S. PATENT DOCUMENTS

| | | | | |
|---|---|---|---|---|
| 2,475,226 | A | 7/1949 | Ellis | |
| 3,102,270 | A * | 9/1963 | Izzo | A41F 1/00 D2/849 |
| 3,919,743 | A * | 11/1975 | Cutler | A41F 1/002 24/303 |
| 4,879,766 | A | 11/1989 | Hull et al. | |
| 4,917,651 | A | 4/1990 | Rainville | |
| 4,941,236 | A | 7/1990 | Sherman et al. | |
| 5,624,296 | A | 4/1997 | Weber-Unger | |
| 6,009,601 | A | 1/2000 | Kaufman | |

(Continued)

FOREIGN PATENT DOCUMENTS

| | | | |
|---|---|---|---|
| CN | 207613289 | U | 7/2018 |
| EP | 1264553 | A1 | 12/2002 |

(Continued)

OTHER PUBLICATIONS

"Belt—Magnetic Clasp Elastic," ScholarWear, https://scholarwear-uniforms.shopify.com/products/belt-magnetic-clasp-elastic, obtained from the internet on Sep. 21, 2023, 3 pages.

(Continued)

*Primary Examiner* — David M Upchurch

(74) *Attorney, Agent, or Firm* — Ryan, Mason & Lewis, LLP

(57) ABSTRACT

A garment includes a first panel comprising a first pocket and a first fastener on the first panel, and a second panel comprising a second pocket and a second fastener on the second panel. The first fastener couples with the second fastener to close a portion of the garment.

20 Claims, 18 Drawing Sheets

(56) References Cited

U.S. PATENT DOCUMENTS

| | | | | |
|---|---|---|---|---|
| 6,163,938 | A * | 12/2000 | Weber-Unger | A44B 13/0047 24/669 |
| 6,606,767 | B2 | 8/2003 | Wong | |
| 6,836,935 | B2 | 1/2005 | Reiter | |
| 7,407,430 | B1 | 8/2008 | Wanzenböck et al. | |
| 7,779,517 | B1 | 8/2010 | Stewart | |
| 8,287,034 | B2 | 10/2012 | Smith et al. | |
| 8,353,544 | B2 | 1/2013 | Fiedler | |
| 8,359,716 | B2 | 1/2013 | Fiedler | |
| 8,430,434 | B2 | 4/2013 | Fiedler | |
| 8,464,403 | B2 | 6/2013 | Fiedler | |
| 8,794,682 | B2 | 8/2014 | Fiedler | |
| 9,049,894 | B2 | 6/2015 | Wong | |
| 9,210,953 | B2 | 12/2015 | Horton | |
| 9,307,808 | B1 * | 4/2016 | Lill | A44B 99/00 |
| D769,608 | S | 10/2016 | Wiens | |
| 9,555,935 | B2 | 1/2017 | Fiedler | |
| 10,172,401 | B1 | 1/2019 | Hopper et al. | |
| 10,212,993 | B2 | 2/2019 | Fiedler et al. | |
| D845,168 | S | 4/2019 | Paik et al. | |
| 10,617,179 | B2 | 4/2020 | Fiedler et al. | |
| 10,702,082 | B2 | 7/2020 | Wong et al. | |
| 10,709,044 | B1 * | 7/2020 | Judy | H05K 9/0009 |
| 10,849,382 | B2 | 12/2020 | Weispfennig | |
| 11,246,368 | B2 | 2/2022 | Hwang et al. | |
| 11,910,845 | B2 | 2/2024 | Cuervo et al. | |
| D1,043,036 | S | 9/2024 | Cuervo et al. | |
| 12,279,656 | B2 | 4/2025 | Cuervo et al. | |
| D1,081,069 | S | 7/2025 | Cuervo et al. | |
| 2002/0000024 | A1 * | 1/2002 | Grunberger | A44B 11/2592 24/303 |
| 2004/0259468 | A1 | 12/2004 | Bergamelli | |
| 2006/0192642 | A1 * | 8/2006 | Ruiz | A41F 1/002 335/207 |
| 2008/0124008 | A1 * | 5/2008 | Meager | A44B 19/36 383/97 |
| 2011/0083254 | A1 | 4/2011 | Trutna et al. | |
| 2013/0065483 | A1 | 3/2013 | Liguori | |
| 2015/0216252 | A1 | 8/2015 | Wiens | |
| 2015/0305432 | A1 | 10/2015 | Wiens | |
| 2016/0000164 | A1 * | 1/2016 | Fildan | A41F 1/006 24/592.1 |
| 2019/0110538 | A1 | 4/2019 | Ghasletwala | |
| 2019/0343239 | A1 | 11/2019 | Fiedler | |
| 2021/0298367 | A1 | 9/2021 | Song | |
| 2023/0389624 | A1 * | 12/2023 | Cuervo | A41F 1/006 |
| 2024/0415240 | A1 * | 12/2024 | Richter | A44B 11/2588 |

FOREIGN PATENT DOCUMENTS

| | | | |
|---|---|---|---|
| EP | 2043475 | B1 | 8/2020 |
| JP | 2012147980 | A | 8/2012 |
| WO | 2021195241 | A1 | 9/2021 |

OTHER PUBLICATIONS

"2 Sets 10x3mm Stainless Steel Magnetic Clasp Leather Bracelet," Etsy, https://www.etsy.com/listing/780247786/2-sets-10x3mm-stainless-steel-magnetic, https://scholarwear-uniforms.myshopify.com/products/belt-magnetic-clasp-elastic, Sep. 4, 2023, 10 pages.

Nathaniel Meyersohn, "Tommy Hilfiger is Making Clothes Easier to Wear for People with Disabilities," https://www.money.cnn.com/2017/10/18/news/tommy-hilfiger-fashion-line-people-with-disabilities/index.html, Oct. 18, 2017, 2 pages.

"Magnetic Clasp Stainless Steel Metal Mesh Milanese Bracelet Watch Band Strap #5041," https://www.nywatchstore.com/magnetic-clasp-stainless-steel-metal-mesh-milanese-bracelet-watch-band-strap-5041.html, obtained from the internet on Sep. 20, 2023, 5 pages.

"Magnetic Hematite Stainless Steel Magnetic Clasp for Leather Bracelet DIY Plain Lock, Magnetic Clasps Jewelry Converter Lobster Clasp, Magnet Clasps Connectors Jewelry Findings, Magnetic Jewelry Clasp Supplier," https://www.hsmagnets.com/product/magnetic-hematite-magnetic-clasp-for-leather-bracelet-diy-plain-lock/, obtained from the internet on Sep. 20, 2023, 1 page.

* cited by examiner

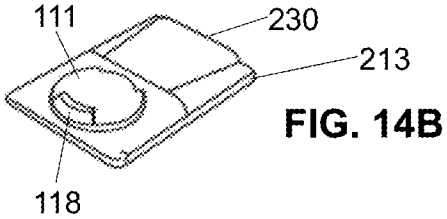
FIG. 14A
FIG. 14B
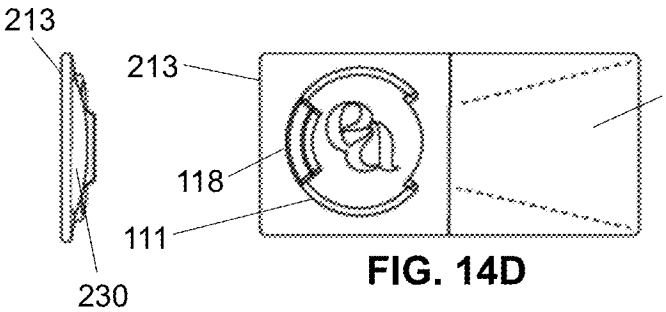
FIG. 14C
FIG. 14D
FIG. 14E
FIG. 14F
FIG. 14G

CLOSURE SYSTEM FOR GARMENTS

FIELD

The field relates generally to a closure system for garments and methods of manufacturing and using same.

BACKGROUND

The Centers for Disease Control and Prevention (CDC) reports that millions of people in the United States experience difficulty while they are dressing or undressing. This difficulty can be due to, for example, an injury, a condition, post-operative recovery, and/or a disability that limits an individual's ability to perform one or more tasks that may be needed while getting dressed or undressed. Accordingly, there is a need for garment designs that facilitate dressing and undressing for individuals who may need assistance with such tasks.

SUMMARY

Illustrative embodiments provide a closure system for garments comprising fasteners configured for engaging with each other, and pockets configured for receiving fingers of a user to provide force necessary to bring the fasteners together.

According to an embodiment, a garment comprises a first panel comprising a first pocket and a first fastener on the first panel, and a second panel comprising a second pocket and a second fastener on the second panel. The first fastener couples with the second fastener to close a portion of the garment.

According to an embodiment, a method for closing a garment, comprises inserting a first finger into a first pocket on a first panel of the garment and inserting a second finger into a second pocket on a second panel of the garment. In the method, the first and second panels are brought in contact with each other to couple a first fastener on the first panel with a second fastener on the second panel.

According to an embodiment, a closure system for a garment comprises a first fastener mounted on a first fabric portion, a first pocket formed on the first fabric portion, a second fastener mounted on a second fabric portion, and a second pocket formed on the second fabric portion. The first fastener is configured to engage with the second fastener to close a portion of the garment.

BRIEF DESCRIPTION OF THE DRAWINGS

FIGS. 14A, 14B, 14C, 14D, 14E, 14F and 14G show top, %, left, front, right, bottom and back views, respectively, of the second fastener on a left side of the bra shown in FIG. 10 in accordance with an embodiment.

DETAILED DESCRIPTION

Figure 1:
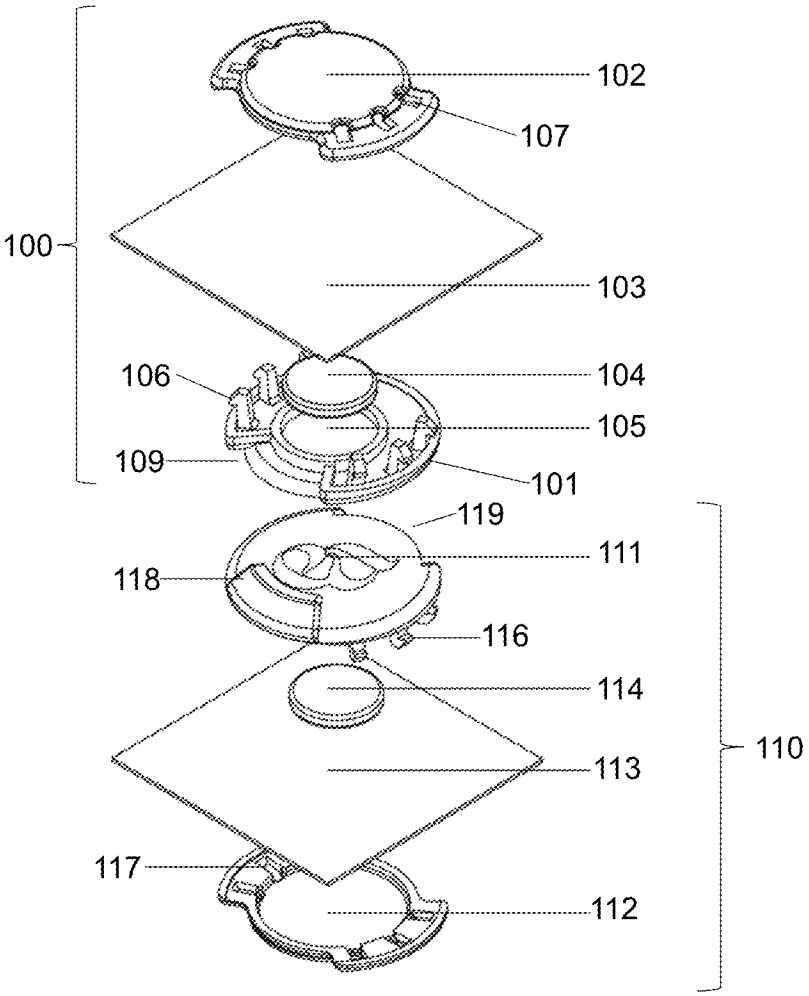
FIG. 1 shows an exploded view of first and second fasteners with fabric in accordance with an embodiment.
Figure 2A:
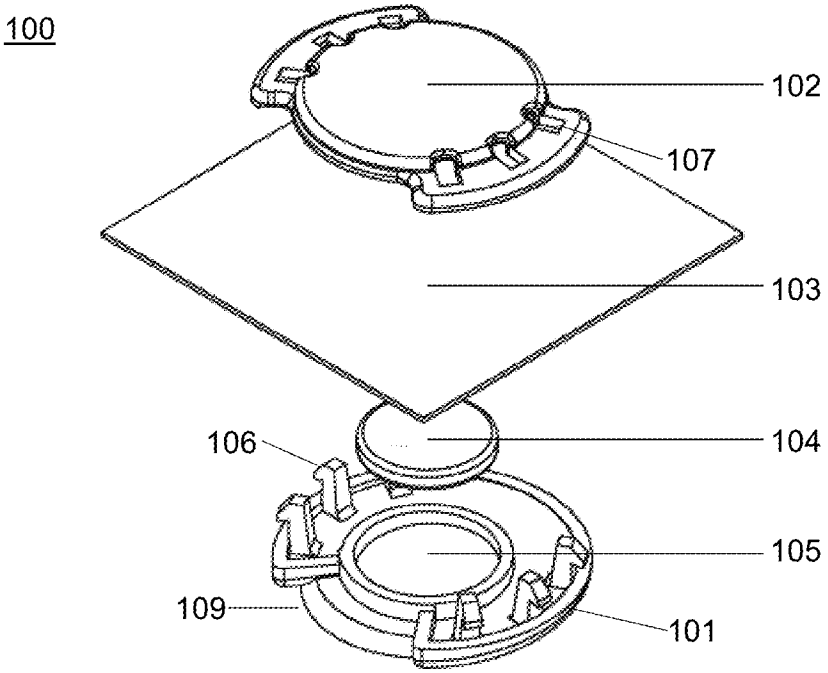
FIG. 2A shows an exploded view of the first fastener with fabric in accordance with an embodiment.
Figure 2C:
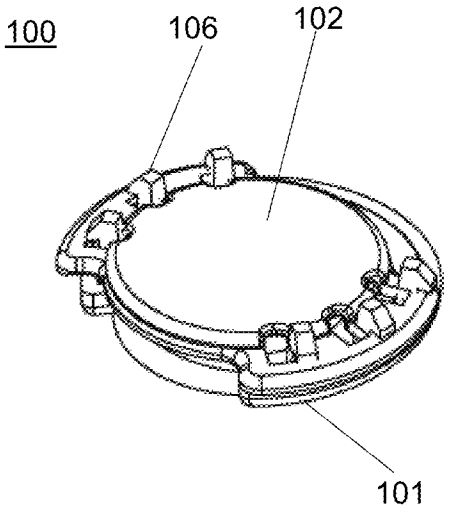
FIG. 2C shows a perspective view of the first fastener in an assembled configuration without fabric in accordance with an embodiment.
Figure 2B:
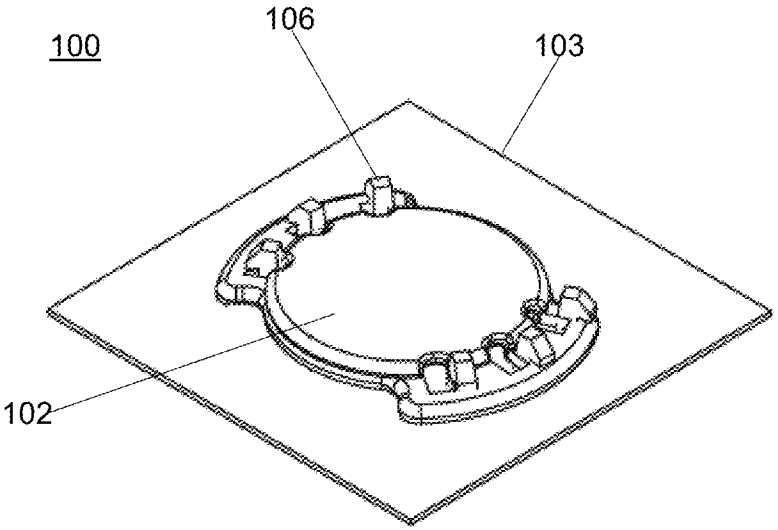
FIG. 2B shows a perspective view of the first fastener in an assembled configuration with fabric in accordance with an embodiment.
Figure 3A:
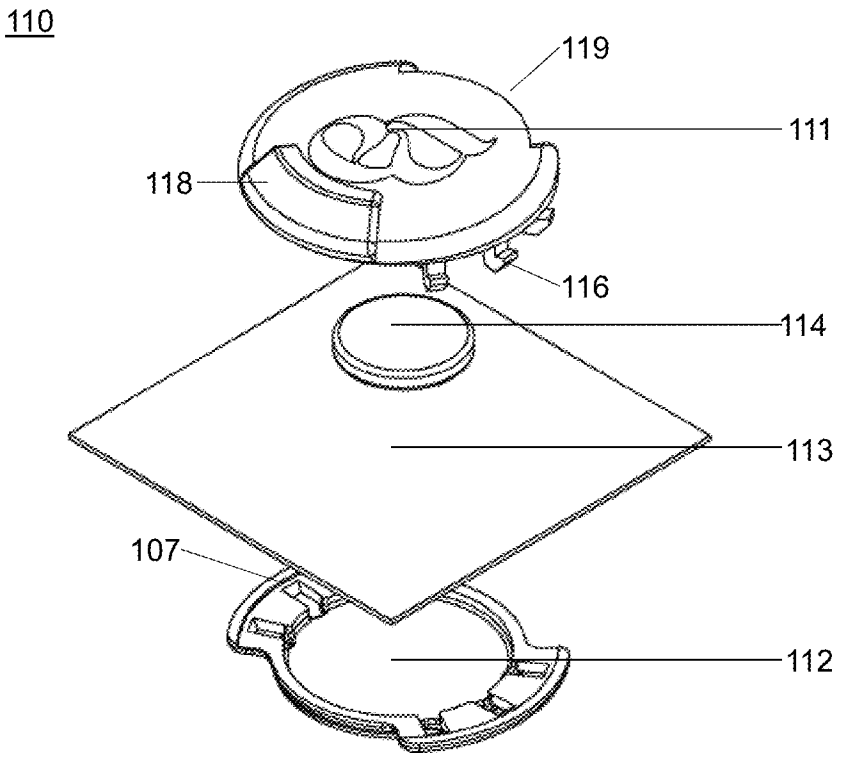
FIG. 3A shows an exploded view of the second fastener with fabric in accordance with an embodiment.
Figure 3C:
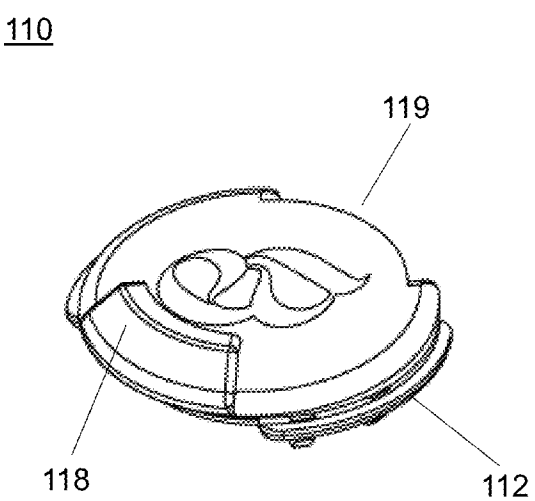
FIG. 3C shows a perspective view of the second fastener in an assembled configuration without fabric in accordance with an embodiment.
Figure 3B:
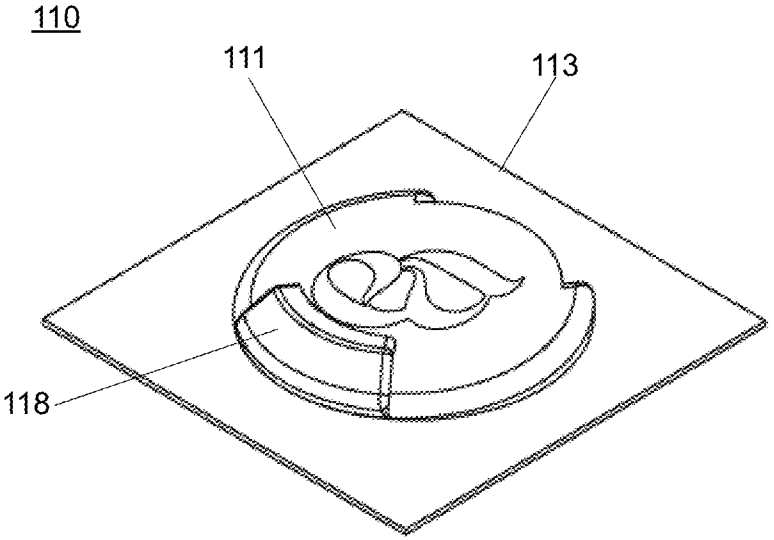
FIG. 3B shows a perspective view of the second fastener in an assembled configuration with fabric in accordance with an embodiment.
Figure 4B:
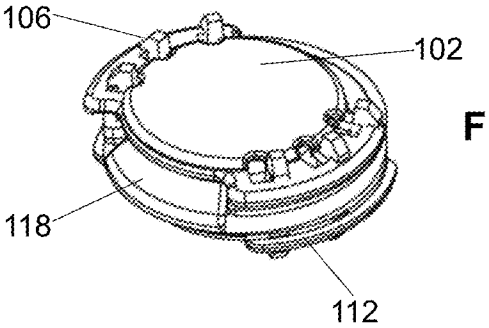
FIGS. 4A, 4B, 4C, 4D, 4E and 4F show top, perspective, left, front, right and bottom views, respectively, of the first and second fasteners in an engaged configuration without fabric in accordance with an embodiment.
Figure 4A:
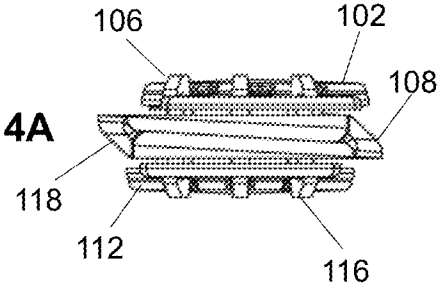
Figure 4D:
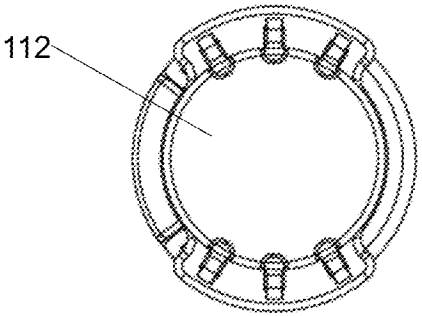
Figure 4E:
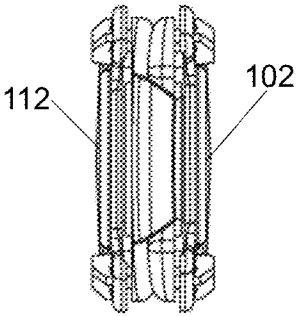
Figure 4C:
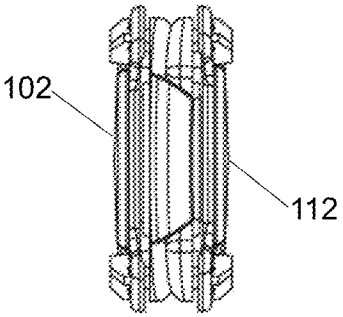
Figure 4F:
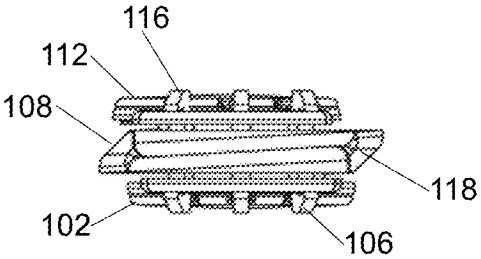
Figure 5A:
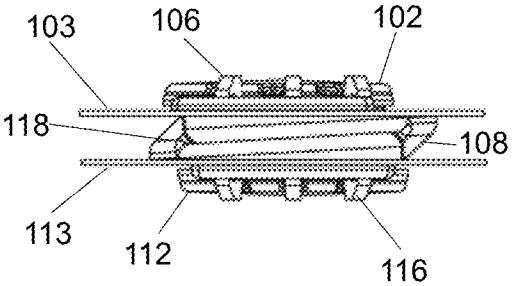
FIGS. 5A, 5B, 5C, 5D, 5E and 5F show top, perspective, left, front, right and bottom views, respectively, of the first and second fasteners in an engaged configuration with fabric in accordance with an embodiment.
Figure 5B:
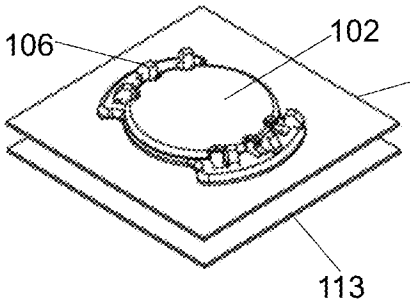
Figure 5C:
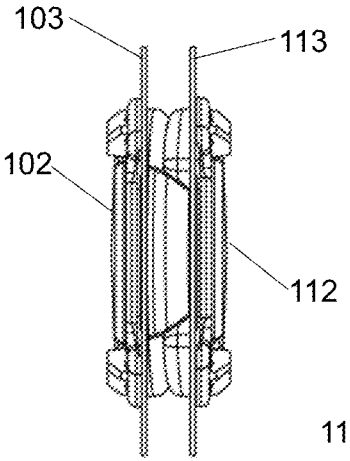
Figure 5D:
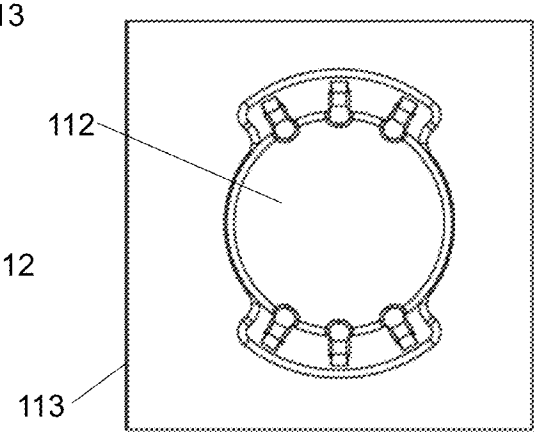
Figure 5E:
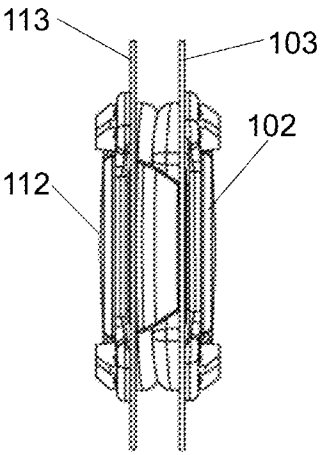
Figure 5F:
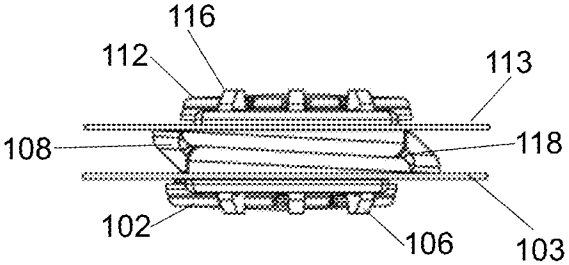
Figures 6A, 6B, 6C, 6D, 6E, 6F, 6G:
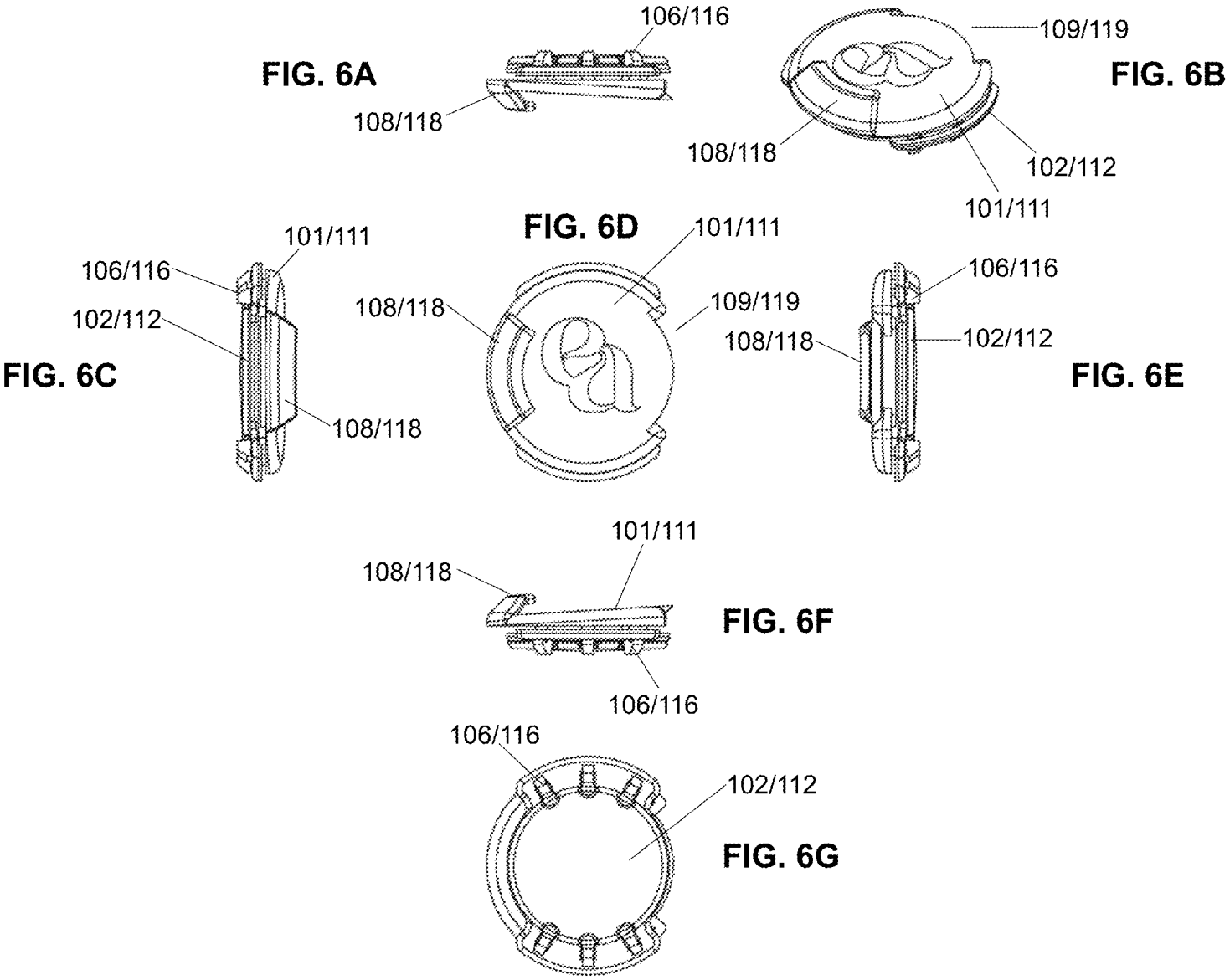
FIGS. 6A, 6B, 6C, 6D, 6E, 6F and 6G show top, perspective, left, front, right, bottom and back views, respectively, of the first or second fasteners without fabric in accordance with an embodiment.
Figures 7A, 7B, 7C, 7D, 7E, 7F, 7G:
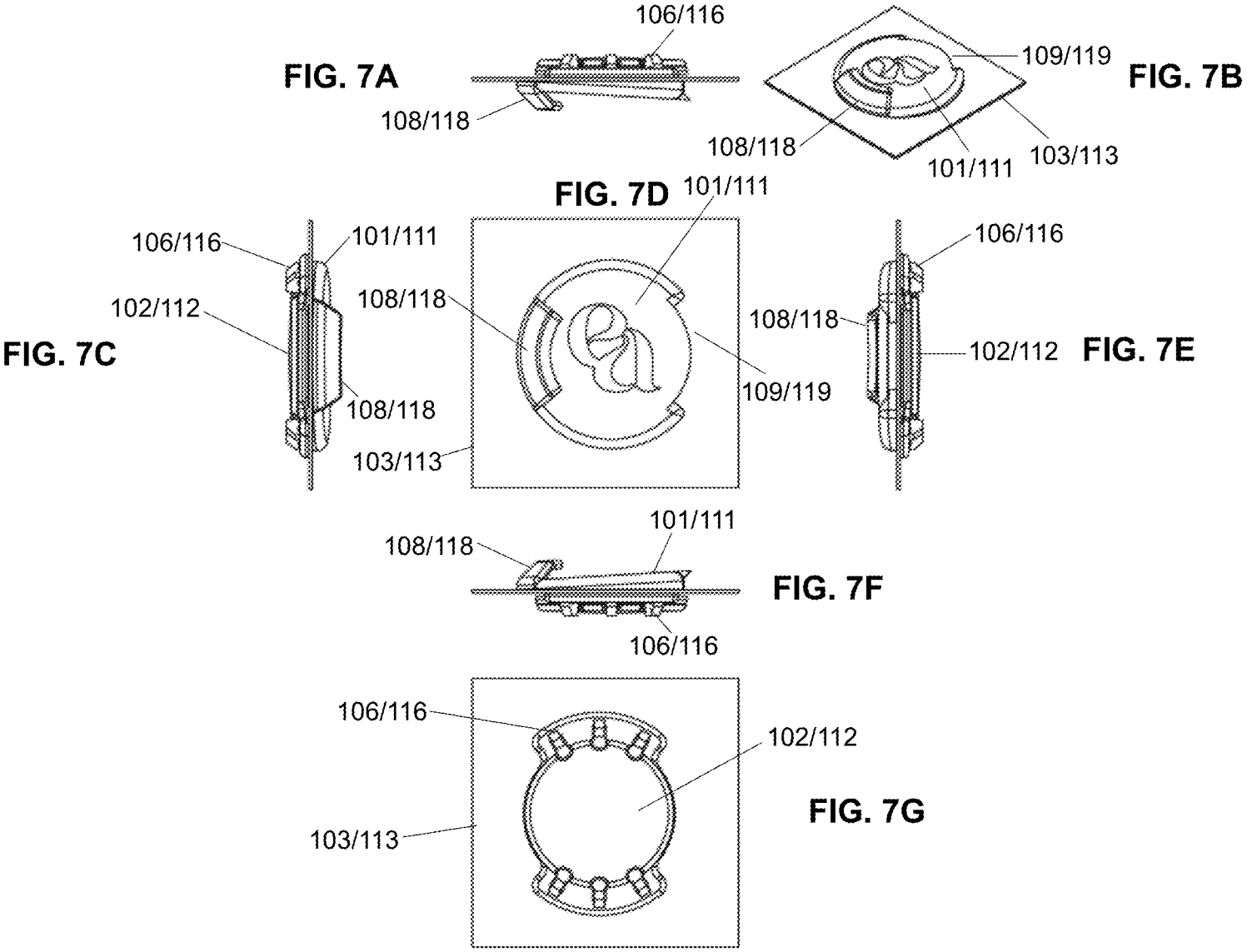
FIGS. 7A, 7B, 7C, 7D, 7E, 7F and 7G show top, perspective, left, front, right, bottom and back views, respectively, of the first or second fasteners with fabric in accordance with an embodiment.

Referring to FIG. 1, a first fastener 100 and a second fastener 110 with corresponding fabric portions 103 and 113 are shown. The first fastener 100 comprises a housing with a back portion 102 and a front portion 101. Similarly, the second fastener 110 comprises a housing with a back portion 112 and a front portion 111. The front portions 101 and 111 are similarly configured, each comprising a plurality of snap fit tabs 106 and 116 and recessed magnet accommodating portions (e.g., recessed portion 105) for receiving magnets 104 and 115. The recessed magnet accommodating portion 105 is shown for the first fastener 100. Although not shown for the second fastener, the front portion 111 of the second fastener 110 also includes a recessed magnet accommodating portion. According to illustrative embodiments, the magnet comprises a 1/16-inch neodymium magnet, but the embodiments are not necessarily limited thereto, and may include another magnet known to one of ordinary skill in the art. The back portions 102 and 112 each comprise a plurality of holes 107 and 117 for receiving respective ones of the plurality of snap fit tabs 106 and 116 through corresponding holes (not shown in FIG. 1) in the fabric portions 103 and 113. Each of the front portions 101 and 111 include a protruding portion (e.g., protruding portion 118) and a receiving portion 109 and 119. Although not shown for the first fastener 100 in FIG. 1, the front portion 101 of the first fastener 100 also includes a protruding portion. When in a coupled or engaged configuration, part of the protruding portion of the first fastener 100 (labelled 108 in subsequent figures described herein) wraps around part of the receiving portion 119 of the second fastener 110, and part of the protruding portion 118 of the second fastener 110 wraps around part of the receiving portion 109 of the first fastener 100.

The receiving portions 109 and 119 each comprise a recessed part, wherein, in a coupled configuration, at least part of the protruding portion of the first fastener 100 and at least part of the protruding portion 118 of the second fastener 110 are respectively inserted into the recessed parts of the receiving portions 119 and 109. In illustrative embodiments, a leading edge of the each of the receiving portions 109 and 119 comprises a chamfer. In illustrative embodiments, the material of the front and back portions 101/111 and 102/112 includes, but is not necessarily limited to, plastic, metal or other material known to one of ordinary skill in the art.

As can be seen in more detail in FIGS. 2A-2C and 3A-3C, the snap fit tabs 106 and 116 have a hook shape. For example, when the first and second fasteners 100 and 110 are assembled with front and back portions of the housings (elements 101 and 102, 111 and 112) coupled to each other, the snap fit tabs 106 and 116 are inserted through holes (not shown) in the fabric portions 103 and 113 and then through corresponding holes 107 and 117 in the back portions 102 and 112. Once through the holes 107 and 117, the hook shape of the snap fit tabs 106 and 116 allows the snap fit tabs 106 and 116 to overlap part of the surface of the back portions 102 and 112 for a secure attachment. As can be understood, the front portions 101 and 111 (also referred to herein as "coupling portions," "first portions" or "first housing portions") are on one side of the fabric portions 103 and 113, and the second housing portions 102 and 112 (also referred to herein as "second portions" or "second housing portions") are on an opposite side of the fabric portions 103 and 113.

Referring to FIGS. 4A-4F and 5A-5F, the first and second fasteners 100 and 110 are engaged with each other in a coupled/engaged configuration. FIGS. 5A-5F are similar to FIGS. 4A-4F, except that FIGS. 5A-5F show the fabric portions 103 and 113, while FIGS. 4A-4F do not show the fabric portions 103 and 113. As shown in FIGS. 4A-4F and 5A-5F, part of the protruding portions 108 and 118 of each of the front portions 101 and 111 respectively wraps around part of the receiving portion 119 of the second fastener 110, and part of the receiving portion 109 of the first fastener 100. In addition, at least part of the protruding portion 108 of the first fastener 100 and at least part of the protruding portion 118 of the second fastener 110 are respectively inserted into the recessed parts of the receiving portions 119 and 109.

Referring, for example, to FIGS. 6A-6G and 7A-7G, the protruding portions 108/118 extend from the front portions 101/111 at an angle (e.g., acute angle) with respect to the top surfaces of the front portions 101/111, and include a hook-like or L-like shape suitable for wrapping around at least part of the receiving portion 109/119 of a mating fastener and being at least partially inserted into a recessed part of the receiving portion 109/119 of a mating fastener. FIGS. 7A-7G are similar to FIGS. 6A-6G, except that FIGS. 7A-7G show the fabric portions 103/113, while FIGS. 6A-6G do not show the fabric portions 103/113.

Figure 8A:
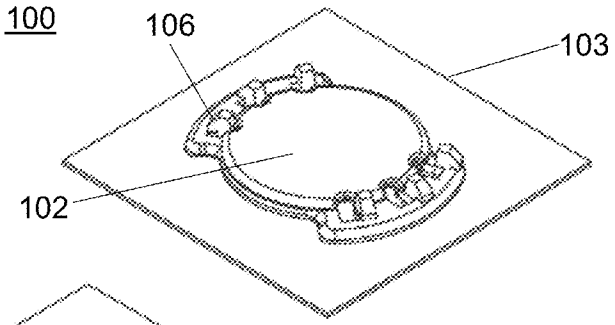
FIGS. 8A and 8B show first and second fasteners individually with fabric in accordance with an embodiment.
Figure 8B:
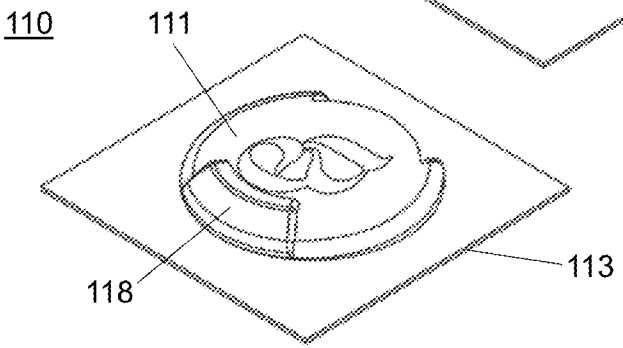
Figure 8C:
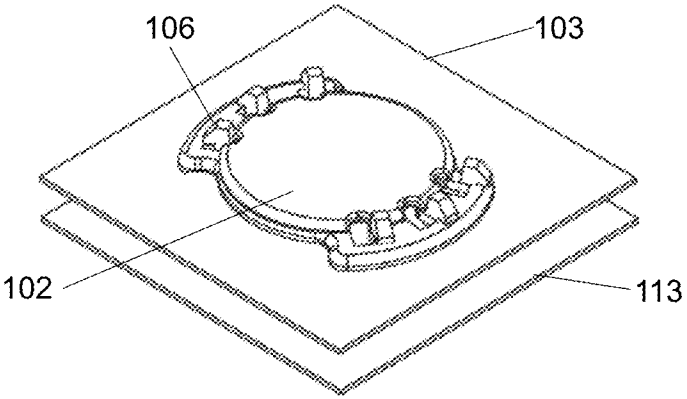
FIG. 8C shows first and second fasteners engaged with each other with fabric in accordance with an embodiment.
Figure 9A:
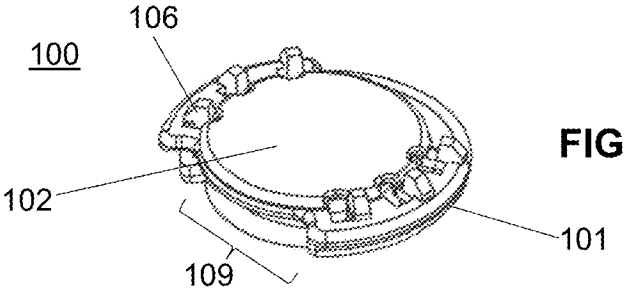
FIGS. 9A and 9B show first and second fasteners individually without fabric in accordance with an embodiment.
Figure 9B:
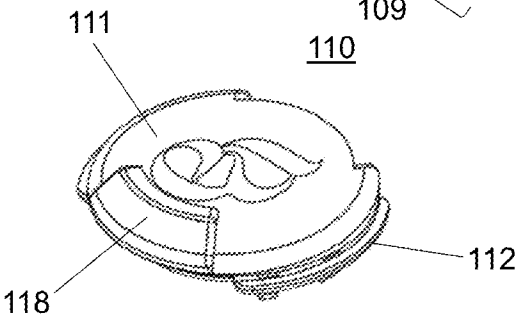
Figure 9C:
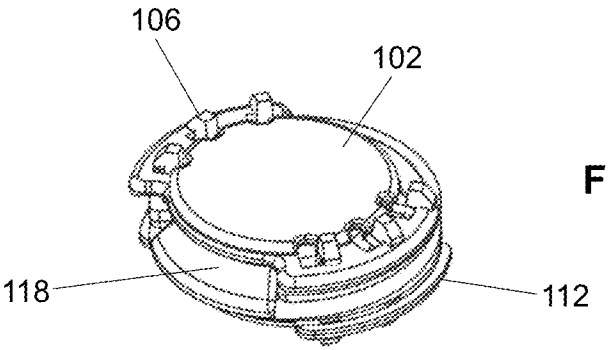
FIG. 9C shows first and second fasteners engaged with each other without fabric in accordance with an embodiment.

FIGS. 8A and 8B show first and second fasteners 100 and 110 individually with fabric portions 103 and 113, and FIG. 8C shows the first and second fasteners 100 and 110 engaged with each other with fabric portions 103 and 113. FIGS. 9A-9C are similar to FIGS. 8A-8C, but do not include the fabric portions 103 and 113 so as to provide additional detail of the engagement of first fastener 100 with second fastener 110.

Figure 10:
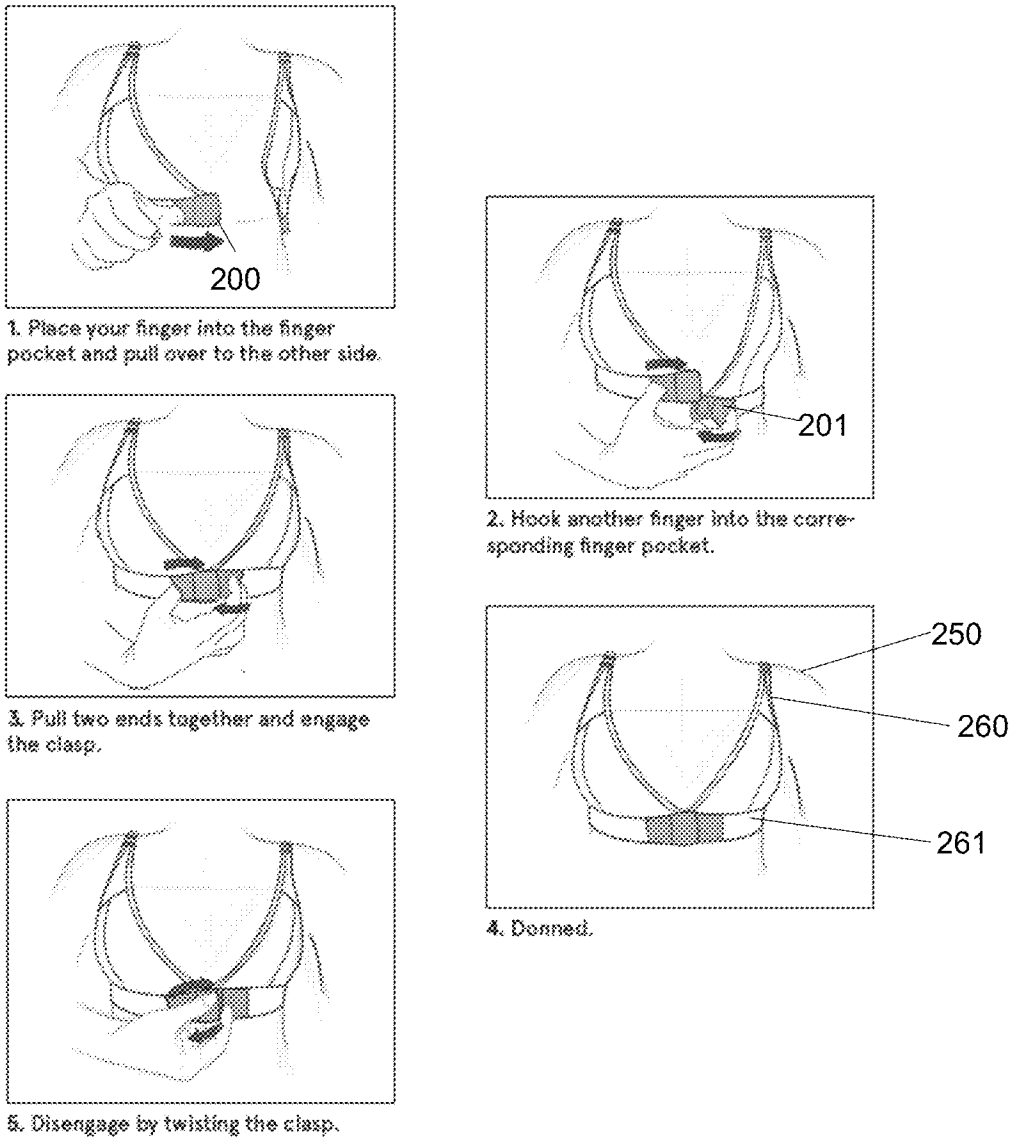
FIG. 10 shows a process for engaging and disengaging first and second fasteners to fasten a bra on a user in accordance with an embodiment.
Figures 11A, 11B, 11C, 11D, 11E, 11F:
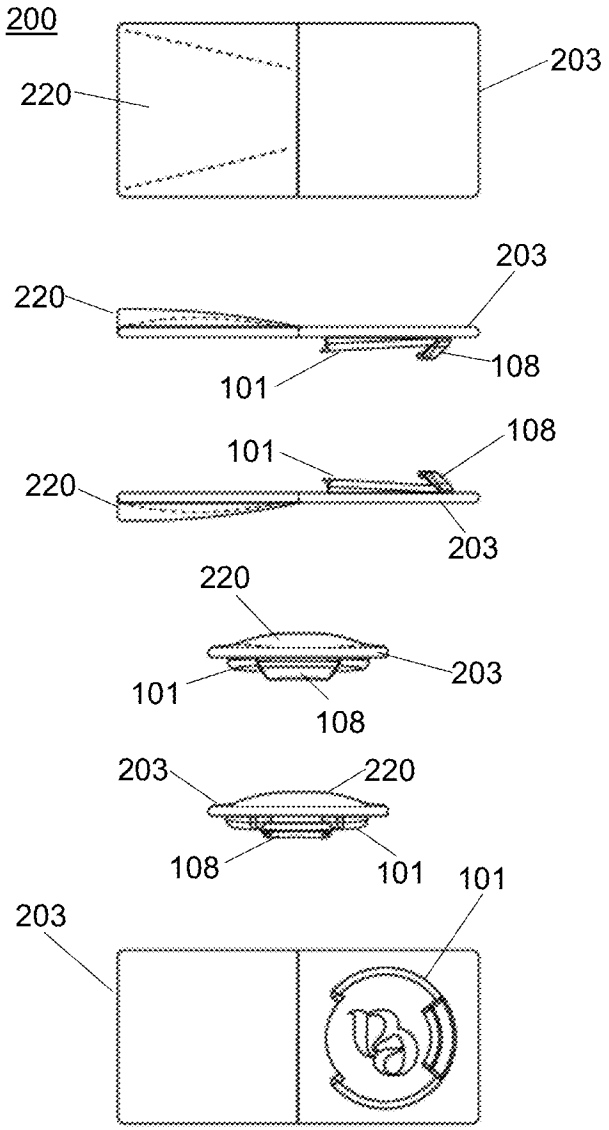
FIGS. 11A, 11B, 11C, 11D, 11E and 11F show front, bottom, top, right, left and back views, respectively, of the first fastener on a right side of the bra shown in FIG. 10 in accordance with an embodiment.
Figures 12A, 12B, 12C, 12D, 12E, 12F:
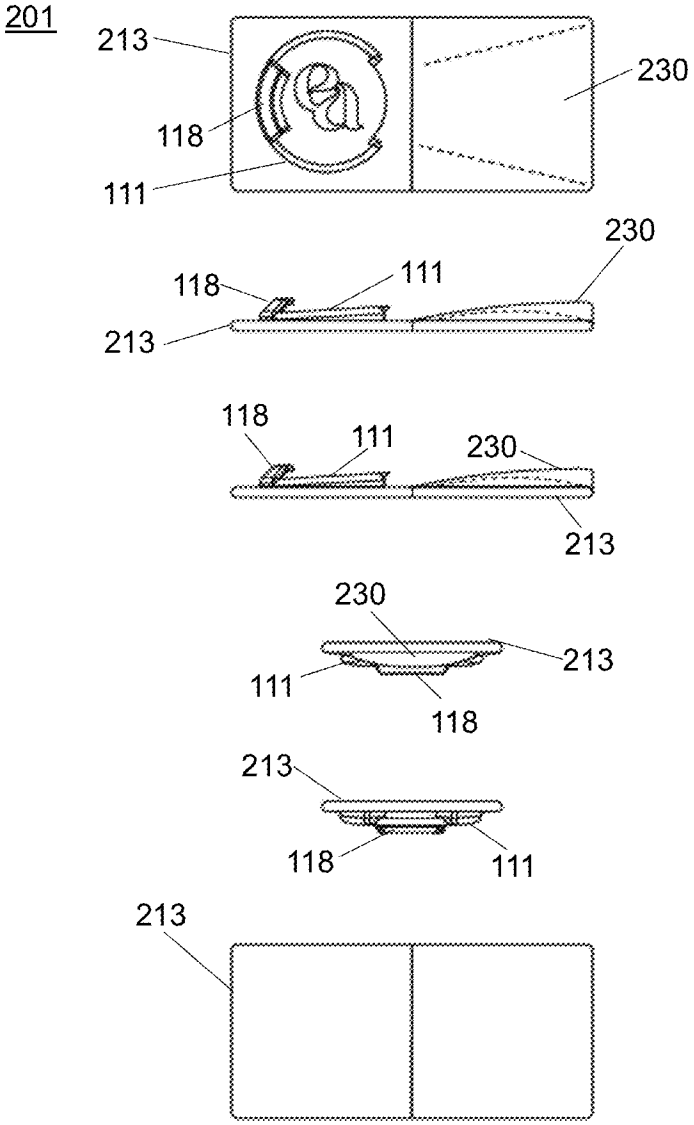
FIGS. 12A, 12B, 12C, 12D, 12E, and 12F show front, bottom, top, right, left and back views, respectively, of the second fastener on a left side of the bra shown in FIG. 10 in accordance with an embodiment.
Figure 13A:
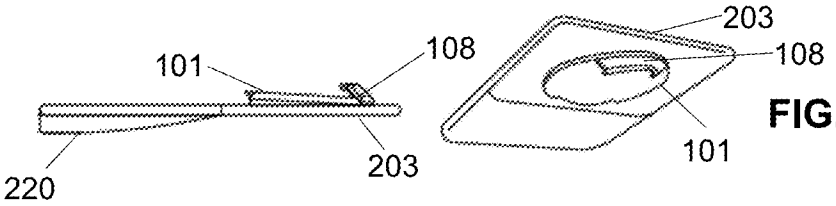
FIGS. 13A, 13B, 13C, 13D, 13E, 13F and 13G show top, %, left, front, right, bottom and back views, respectively, of the first fastener on a right side of the bra shown in FIG. 10 in accordance with an embodiment.
Figure 13B:
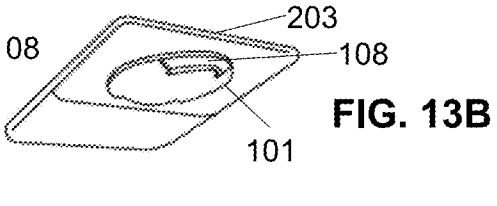
Figure 13C:
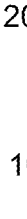
Figure 13D:
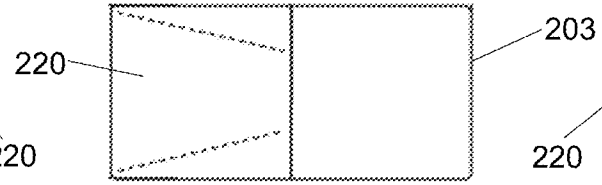
Figure 13E:
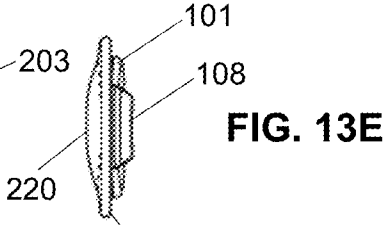
Figure 13F:
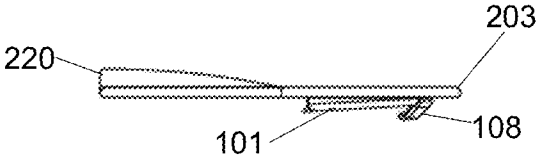
Figure 13G:
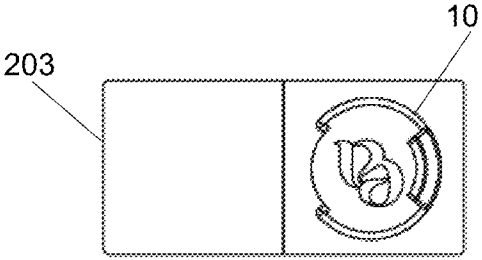
Figure 15B:
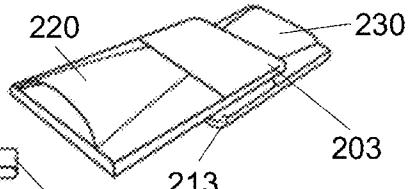
FIGS. 15A, 15B, 15C, 15D, 15E, 15F and 15G show top, %, right, front, left, bottom and back views, respectively, of the first and second fasteners engaged with each other on the bra shown in FIG. 10 in accordance with an embodiment.
Figure 15A:
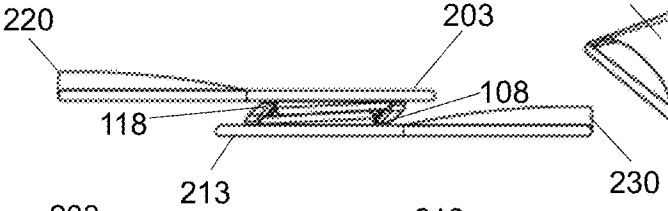
Figure 15D:
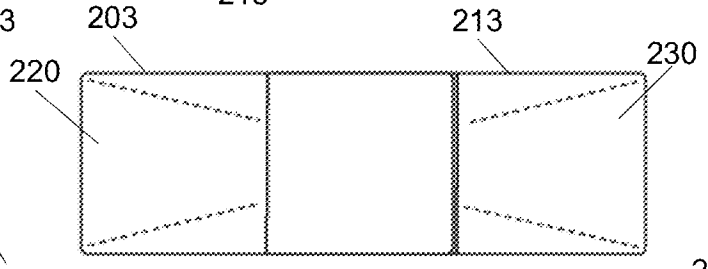
Figure 15C:
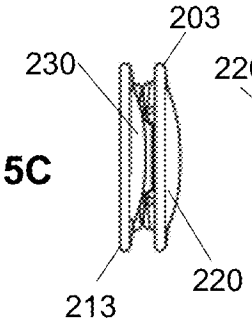
Figure 15E:
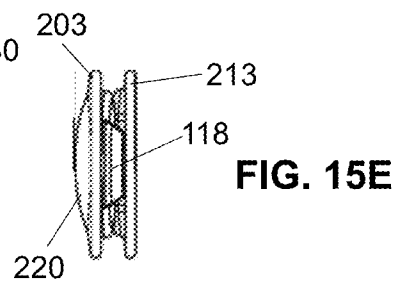
Figure 15F:
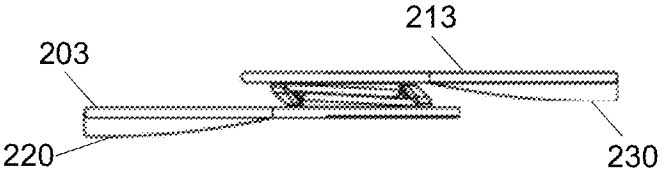
Figure 15G:
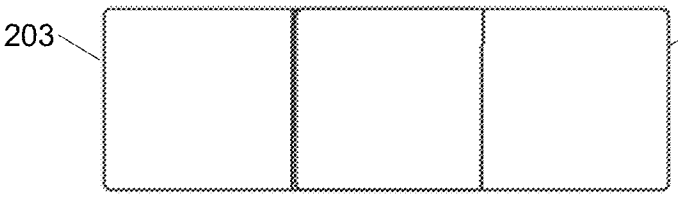

Referring to FIG. 10, a process is shown for engaging and disengaging first and second fasteners 100 and 110 to fasten a bra 260 on a user 250. As can be seen in FIG. 10, and also with reference to FIGS. 11A-11F, 12A-12F, 13A-13G, 14A-14G and 15A-15G, a first finger of the user 250 is inserted into a first pocket 220 on a first panel 200 of the bra 260. A second finger of the user 250 in inserted into a second pocket 230 on a second panel 201 of the bra 260. The first and second panels 200 and 201 are brought in contact with each other to couple a front portion 101 of a first fastener 100 on the first panel 200 with a front portion 111 of a second fastener 110 on the second panel 201. As can be seen by the arrows in FIG. 10, bringing the first and second panels 200 and 201 in contact with each other comprises exerting force (e.g., pulling) on the first and second panels 200 and 201 through the first and second fingers in the first and second pockets 220 and 230. Coupling the front portion 101 of the first fastener 100 with the front portion 111 of the second fastener 110 comprises engaging the protruding portion 108 with the receiving portion 119 and engaging the protruding portion 118 with the receiving portion 109. In addition to the protruding portions 108/118 and receiving portions 109/119, the fasteners are held together by the magnets 104 and 114. For example, the coupling side of magnet 104 (e.g., side facing the magnet 114) has a first polarity and the coupling side of magnet 114 (e.g., side facing the magnet 104) has a second polarity opposite the first polarity so that the magnets 104 and 114 attract each other. As can be seen in FIG. 10, the bra 260 may be unfastened (e.g., fasteners 100 and 110 disengaged) by twisting the fasteners in, for example, a clockwise or counterclockwise motion. The panels 200 and 201 are located on a front portion of a band 261 of the bra 260.

As can be seen in FIGS. 11A-11F, 12A-12F, 13A-13G, 14A-14G and 15A-15G, the panel 200 includes at least one fabric portion 203, which may be the same or similar to fabric portion 103, and the panel 201 includes at least one fabric portion 213, which may be the same or similar to fabric portion 113. The panels 200 and 201 may also include additional layers of fabric. For example, an additional layer(s) of fabric may cover the back portions 102 and 112 of the first and second fasteners 100 and 110 to conceal the back portions 102 and 112. The fabric portions and other fabric layers comprise, for example, materials for garments and undergarments known to those of ordinary skill in the art such as, but not necessarily limited to, cotton, elastic, spandex, polyester, etc.

As can be seen in FIGS. 11A-11F, 13A-13G, and 15A-15F, the first pocket 220 is on a first surface of the panel 200 (e.g., fabric portion 203), and the front portion 101 (e.g., coupling portion) of the first fastener 100 is on a second surface of the panel 200 under the first surface. In other words, the first pocket 220 and the front portion 101 (e.g., coupling portion) of the first fastener 100 are not on the same surface of the panel 200 and are on opposite surfaces. For example, the pocket 220 is on a top surface of the panel 200 (or fabric portion 203) and the front portion 101 (e.g., coupling portion) of the first fastener 100 is on a bottom surface of the panel 200. With respect to left and right orientation, the first pocket 220 and the front portion 101 of the first fastener 100 are offset from each other (e.g., the first pocket 220 is on a left side and the front portion 101 is on a right side of the panel 200 as shown in the figures).

As can be seen in FIGS. 12A-12F, 14A-14G, and 15A-15F, the second pocket 230 is on same surface of the panel 201 (e.g., fabric portion 213) as the front portion 111 (e.g., coupling portion) of the second fastener 110. For example, the pocket 230 and the front portion 111 (e.g., coupling portion) of the second fastener 110 are both on a top surface of the panel 201 (or fabric portion 213). With respect to left and right orientation, the second pocket 230 is adjacent the front portion 111 of the second fastener 200 (e.g., the second pocket 230 is on a right side and the front portion 111 is on a left side of the panel 201 as shown in the figures).

As can be seen, for example, in FIGS. 11B, 11C, 11D, 11E, 12B, 12C, 12D, 13A, 13C, 13E, 13F, 14A, 14B, 14C, 14F, 15A, 15B, 15C, 15E and 15F, the pockets 220 and 230 are raised and include a space between the pocket material and the surface of the panel 200/201 in which, for example, a finger may be inserted. The pockets 220 and 230 may be stitched to or attached to the panels 200/201 in ways know to those of ordinary skill in the art.

Figure 16:
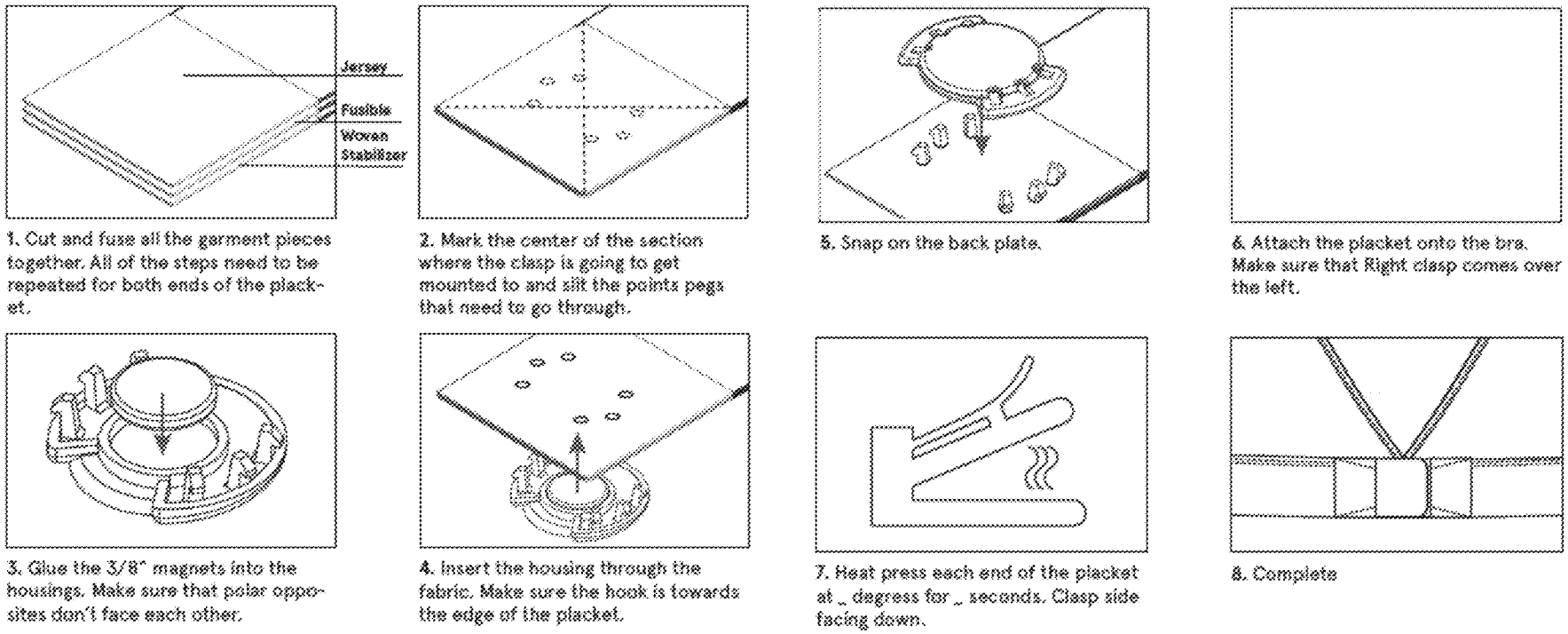
FIG. 16 shows a process for assembling a fastener onto a garment in accordance with an embodiment.

Referring to FIG. 16, a process for assembling a fastener onto a garment is shown. In the process, garment pieces are cut and fused together, with steps being repeated for both ends of the panels 200 and 201 (panels may also be referred to herein as "plackets"). The center of a section of fabric (e.g., fabric portion 103/203/113/213) where the fastener (also referred to herein as a "clasp") is to be mounted is marked, and holes or slits where the snap fit tabs 106/116 are to go through are formed. The magnet 104/114 is placed and glued in the recessed magnet accommodating portion (e.g., recessed magnet accommodating portion 105) of the front portion 101/111 with the polarity oriented so that the magnet 104/114 will attract a magnet 104/114 of an opposite fastener 100/110. The snap fit tabs 106/116 are inserted through the fabric portion(s) (e.g., fabric portion 103/203/113/213) so that the hook-like shapes face out toward the edge of the panels 200/201. The back portion of the housing (e.g., portions 102 and 112) are snapped onto the snap fit tabs 106/116 by inserting the snap fit tabs 106/116 through the holes 107/117. The panels 200 and 201 are attached to the bra 260 or another garment. In an illustrative embodiment, the right fastener is disposed over the left fastener. Ends of panel 200/201 are heat pressed to the garment, fastener side facing down.

Although described in terms of a bra, the embodiments are not necessarily limited thereto, and may be applied to other garments or articles of clothing such as, for example, underwear (e.g., to the waistband of underwear), shirts, pants, shorts, skirts, etc.

The embodiments advantageously provide a closure system for garments which facilitates fastening and unfastening of garments and provides solutions for individuals who may need simplified fastening configurations and/or adaptive clothing.

Although exemplary embodiments of the present invention have been described hereinabove, it should be understood that the present invention is not limited to these embodiments but may be modified by those skilled in the art without departing from the spirit and scope of the present invention. For example, the functionality described herein may be applied to other embodiments as enhancements or improvements as the design becomes progressively elaborative.

What is claimed is:

1. A garment comprising:

a first panel comprising a first pocket and a first fastener on the first panel; and a second panel comprising a second pocket and a second fastener on the second panel;

wherein the first fastener couples with the second fastener to close a portion of the garment; and wherein each of the first and second fasteners comprises a housing which comprises a first portion and a second portion, wherein each of the first portions comprises a plurality of tabs and each of the second portions comprises a plurality of holes configured to receive respective ones of the plurality of tabs.

2. The garment of claim 1, wherein:

the first fastener comprises a first protruding portion and a first receiving portion;

the second fastener comprises a second protruding portion and a second receiving portion; and in a coupled configuration of the first and second fasteners, the first protruding portion engages the second receiving portion, and the second protruding portion engages the first receiving portion.

3. The garment of claim 2, wherein, in the coupled configuration, at least part of the first protruding portion wraps around part of the second receiving portion, and at least part of the second protruding portion wraps around part of the first receiving portion.

4. The garment of claim 2, wherein each of the first and second receiving portions comprises a recessed part, and wherein, in the coupled configuration, at least part of the first protruding portion and at least part of the second protruding portion are respectively inserted into the recessed parts of the second and first receiving portions.

5. The garment of claim 2, wherein each of the first and second receiving portions comprises a chamfer.

6. The garment of claim 1, wherein the first fastener comprises a first magnet having a coupling side with a first polarity and second magnet having a coupling side with a second polarity opposite the first polarity.

7. The garment of claim 1, wherein the first pocket is on a first surface of the first panel and at least a coupling portion of the first fastener is on a second surface of the first panel, wherein the second surface is under the first surface.

8. The garment of claim 7, wherein the second pocket and at least a coupling portion of the second fastener are on a same surface of the second panel.

9. The garment of claim 1, wherein the garment comprises a bra, and the first and second panels are parts of a band of the bra.

10. The garment of claim 1, wherein the first and second portions of each of the first and second fasteners are circular-shaped.

11. The garment of claim 1, wherein each the first and second panels comprises fabric portions including a plurality of additional holes corresponding to the plurality of holes of the second portions and configured to receive the respective ones of the plurality of tabs.

12. A method for closing a garment which comprises a first panel comprising a first pocket and a first fastener on the first panel, and a second panel comprising a second pocket and a second fastener on the second panel, wherein each of the first and second fasteners comprises a housing which comprises a first portion and a second portion, wherein each of the first portions comprises a plurality of tabs, and wherein each of the second portions comprises a plurality of holes configured to receive respective ones of the plurality of tabs, wherein closing the garment comprises:

inserting a first finger into the first pocket of the first panel of the garment;

inserting a second finger into the second pocket of the second panel of the garment; and bringing the first and second panels in contact with each other to couple the first fastener on the first panel with the second fastener on the second panel.

13. The method of claim 12, wherein bringing the first and second panels in contact with each other comprises exerting force on the first and second panels through the first and second fingers in the first and second pockets.

14. The method of claim 12, wherein:

the first fastener comprises a first protruding portion and a first receiving portion;

the second fastener comprises a second protruding portion and a second receiving portion; and coupling the first fastener with the second fastener comprises engaging the first protruding portion with the second receiving portion and engaging the second protruding portion with the first receiving portion.

15. A closure system for a garment comprising:

a first fastener mounted on a first fabric portion;

a first pocket formed on the first fabric portion;

a second fastener mounted on a second fabric portion; and a second pocket formed on the second fabric portion;

wherein the first fastener is configured to engage with the second fastener to close a portion of the garment; and wherein each of the first and second fasteners comprises a housing which comprises a first portion and a second portion, wherein each of the first portions comprises a plurality of tabs, and wherein each of the second portions comprises a plurality of holes configured to receive respective ones of the plurality of tabs.

16. The closure system of claim 15, wherein the first pocket is on a first surface of the first fabric portion and at least an engaging portion of the first fastener is on a second surface of the first fabric portion, wherein the second surface is under the first surface.

17. The closure system of claim 16, wherein the second pocket and at least an engaging portion of the second fastener are on a same surface of the second fabric portion.

18. The closure system of claim 15, wherein the first and second portions of each of the first and second fasteners are circular-shaped.

19. The closure system of claim 15, wherein each the first and second fabric portions comprises a plurality of additional holes corresponding to the plurality of holes of the second portions and configured to receive the respective ones of the plurality of tabs.

20. The closure system of claim 15, wherein:

the first fastener comprises a first protruding portion and a first receiving portion;

the second fastener comprises a second protruding portion and a second receiving portion; and in an engaged configuration of the first and second fasteners, the first protruding portion engages the second receiving portion, and the second protruding portion engages the first receiving portion.

* * * * *